US010436427B1

(12) United States Patent
Rons

(10) Patent No.: US 10,436,427 B1
(45) Date of Patent: Oct. 8, 2019

(54) LIGHT AND POWER DISTRIBUTION SYSTEM FOR NON-OCCUPIED STRUCTURES

(71) Applicant: Nathan L Rons, Littleton, CO (US)

(72) Inventor: Nathan L Rons, Littleton, CO (US)

( * ) Notice: Subject to any disclaimer, the term of this patent is extended or adjusted under 35 U.S.C. 154(b) by 75 days.

(21) Appl. No.: 15/252,360

(22) Filed: Aug. 31, 2016

(51) Int. Cl.
*F21V 23/00* (2015.01)
*F21V 23/06* (2006.01)
*F21V 23/04* (2006.01)
*F21Y 115/10* (2016.01)

(52) U.S. Cl.
CPC ..... *F21V 23/001* (2013.01); *F21V 23/003* (2013.01); *F21V 23/04* (2013.01); *F21V 23/0471* (2013.01); *F21V 23/06* (2013.01); *F21Y 2115/10* (2016.08)

(58) Field of Classification Search
CPC ..... F21V 23/001; F21V 23/008; F21V 23/0471–0492; F21S 8/024; F21S 8/033
See application file for complete search history.

(56) References Cited

U.S. PATENT DOCUMENTS 3,439,309 A 4/1969 Giger, Jr. et al.
4,703,171 A * 10/1987 Kahl ..... G08B 13/19 250/221
5,808,235 A * 9/1998 Burton ..... H01R 4/66 174/6
7,034,414 B1 * 4/2006 Foerg ..... H02J 9/06 290/1 A
2004/0187400 A1 * 9/2004 Anderson ..... E04B 1/34321 52/79.1
2005/0201190 A1 9/2005 Kowalski
2007/0068094 A1 * 3/2007 Fralish ..... E04H 1/1205 52/143
2013/0067846 A1 * 3/2013 Kvols ..... E04H 1/1205 52/586.1
2014/0116870 A1 * 5/2014 Kamen ..... E04H 1/1205 202/83
2015/0062769 A1 * 3/2015 Cortes Rico ..... H02H 3/08 361/93.1
2016/0194891 A1 * 7/2016 McDaniel, Jr. ..... E04H 1/1205 52/36.4
2016/0336721 A1 * 11/2016 Ricciuti ..... H02B 1/38

* cited by examiner

*Primary Examiner* — Bao Q Truong
*Assistant Examiner* — Steven Y Horikoshi

(57) ABSTRACT

A Light and Power Distribution System for Non-Occupied Structures for providing electrical and lighting capabilities without the need for an electrician or inspections. The Light and Power Distribution System for Non-Occupied Structures includes a main housing assembly coupled to a wall of a structure; a main power connection cable for electrically coupling to an electrical service; and at least one electrical outlet operationally coupled to the main housing assembly and electrically coupled to said main power connection cable.

4 Claims, 2 Drawing Sheets

LIGHT AND POWER DISTRIBUTION SYSTEM FOR NON-OCCUPIED STRUCTURES

BACKGROUND OF THE INVENTION

Field of the Invention

The present invention relates to electrical wiring systems and more particularly pertains to a new Light and Power Distribution System for Non-Occupied Structures providing electrical power and lights with minimal access to the interior of walls or the need for an electrician.

Description of the Prior Art

The use of electrical wiring systems is known in the prior art. More specifically, electrical wiring systems heretofore devised and utilized are known to consist basically of familiar, expected and obvious structural configurations. Illustrative examples of known prior art include the following:

United States Published Patent Application Number 20050201190 for Robert Kowalski discloses a prefabricated electrical connector based electrical distribution system.

U.S. Pat. No. 3,439,309 to Walter Giger Jr. et. al. discloses a plug-in type electrical power distribution system.

In these respects, the Light and Power Distribution System for Non-Occupied Structures according to the present invention substantially departs from the conventional concepts and designs of the prior art, and in so doing provides an apparatus primarily developed for the purpose of providing a user installed or retrofit electrical system without the need for an electrician. The system can be used on a temporary basis or on a permanent basis with the use of the ground rod as described below.

SUMMARY OF THE INVENTION

In view of the foregoing disadvantages inherent in the known types of electrical wiring systems now present in the prior art, the present invention provides a new Light and Power Distribution System for Non-Occupied Structures construction wherein the same can be utilized for providing a user installed or retrofit electrical system without the need for an electrician.

Generally, this disclosure considered "non-occupied structures" to be those common used for storage sheds, temporary structures, guard houses, trailers, car ports, shipping containers, and other structures not meant for permanent occupancy. Many of these types of structures may be purchased as pre-fabricated units from big box stores, lumber yards, and web-based direct sales. Typically these structures are not wired for electrical services.

To attain this, the present invention generally comprises a main housing assembly coupleable to a wall of a structure, a main power connection cable for electrically coupling to an electrical service, and at least one electrical outlet operationally coupled to the main housing assembly and electrically coupled to said main power connection, all of which are prefabricated for the structure which allows the user to install the system without the services of an electrician.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is the ability to configure a non-occupied building for power and lighting quickly and without the need for professional tradesman or inspections.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
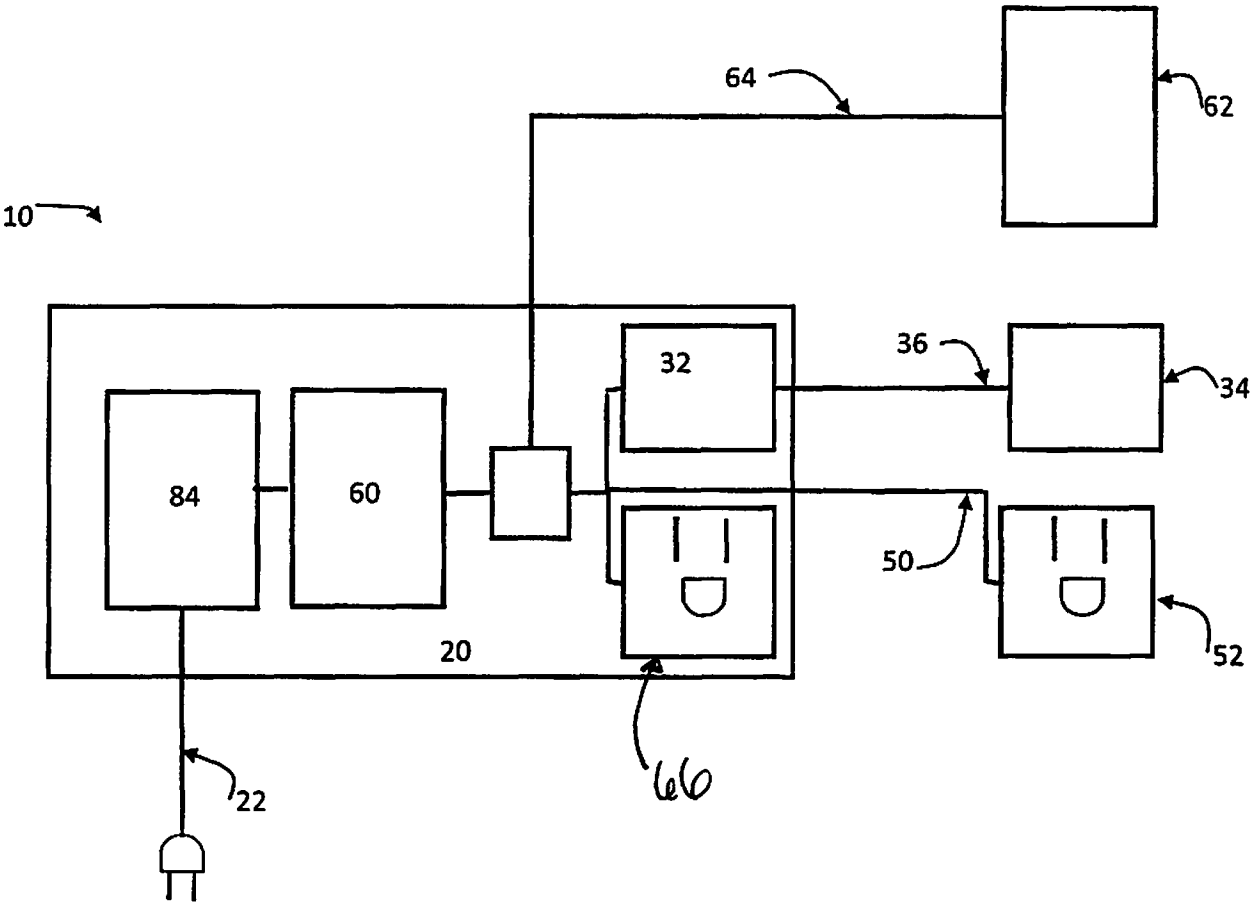
FIG. 1 is a schematic block diagram of a new Light and Power Distribution System for Non-Occupied Structures according to the present invention.
Figure 2:
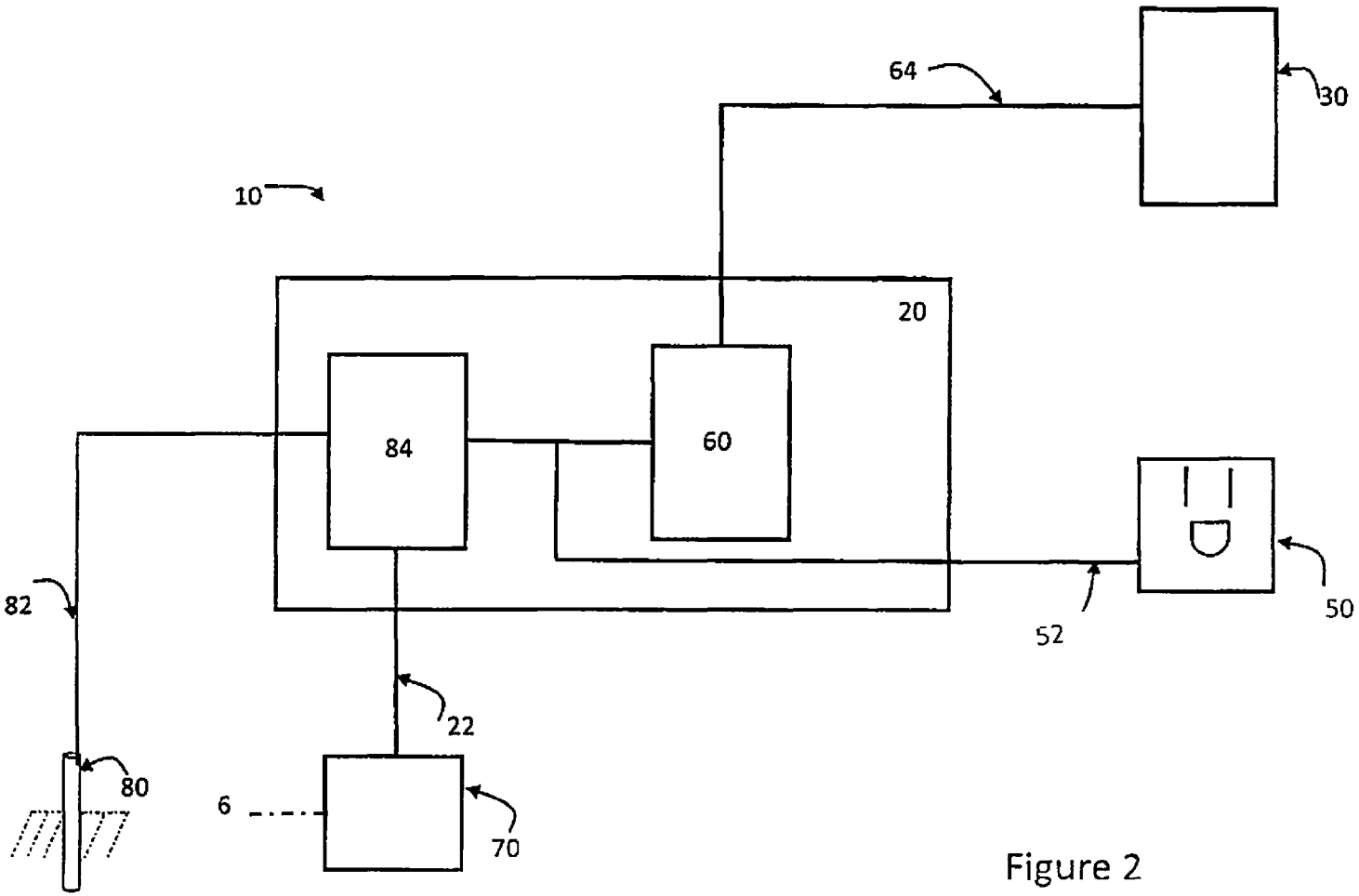
FIG. 2 is a schematic functional block diagram view of the present invention.

With reference now to the drawings, and in particular to FIGS. 1 through 2 thereof, a new Light and Power Distribution System for Non-Occupied Structures embodying the principles and concepts of the present invention and generally designated by the reference numeral 10 will be described.

As best illustrated in FIGS. 1 through 2, the Light and Power Distribution System for Non-Occupied Structures 10 generally comprises a main housing assembly 20 coupleable to a wall 4 of a structure 2; a main power connection cable 22 for electrically coupling to an electrical service 6; and at least one electrical outlet 66 operationally coupled to the main housing assembly 20 and electrically coupled to said main power connection cable 22.

In at least one preferred embodiment, the main power connection cable 22 is designed to be electrically coupled to an 110V household outlet.

Typically the system 10 also includes at least one illumination member 30 electrically coupled to said main power connection. The illumination member may be an incandescent bulb, a halogen bulb, a tungsten bulb, a Xenon bulb, a metal halide high-intensity discharge bulb, a sodium high-intensity discharge bulb, a mercury vapor bulb, a fluorescent lamp, an electroluminescent lamp, or at least one light emitting diode (LED).

In a preferred embodiment, the system includes an LED Driver Assembly 32 operationally coupled between said main power connection cable 22 and at least one LED assembly 34.

In a further embodiment, the LED Driver Assembly 32 is positioned within the main housing assembly 20 and a Lighting Routing Cable 36 is electrically coupled between said LED Driver Assembly 32 and said LED Assembly 34. The Lighting Routing Cable 36 facilitates placement of the LED Assembly 34 remotely from said Main Housing Assembly 20. Typically, the LED Driver assembly will step down the voltage from the main power connection cable (nominally 110V) to 12V and convert the power from AC to DC. This conversion allows for a low voltage solution to be used for lighting reducing the changes of fire or accidental electrocution.

In a further embodiment the Lighting Routing Cable 36 includes the capability of quick connection/disconnection from the Main Housing Assembly 20 and/or said LED Assembly 34.

In still a further embodiment, the system 10 may also include at least one Remote Outlet Assembly 50 for providing household power, and at least one Outlet Routing Cable 52 electrically coupled between the main power connection cable 22 and at least one Remote Outlet Assembly 50, to facilitating placement of the Remote Outlet Assembly 50 remotely from said Main Housing Assembly 20.

In yet a further embodiment, the Outlet Routing Cable also includes the capability of quick connection/disconnection from the Main Housing Assembly and/or said Remote Outlet Assembly.

The system may also utilize a Switch Member 60 or an occupancy sensor (which may be a motion sensor) 62 positioned substantially within the main housing assembly 20 and electrically coupled between the main power connection cable 22 and said LED Assembly 34 for selectively turning said LED Assembly on/off.

In an alternate embodiment, the Switch Member 60 or Occupancy Sensor 62 may be positioned outside of the Main Housing Assembly 20 and connected via a Remote Switch Cable 64.

In at least one embodiment, the system also includes a Bulkhead Hatch Assembly 70 capable of being positioned substantially through a wall 4 of the Non-Occupied Structure 2 for operationally routing the main power connection cable 22 and facilitating connection to an external power source.

The system may also include a Ground Rod 80 which can be at least partially inserted into the ground adjacent to the Non-Occupied Structure 2, and a Ground Connection Cable 82 conductively coupled between the Ground Rod 80 and said Main Housing Assembly 20 with the Ground Connection Cable 82 being conductively coupled to a ground wire of said Main Power Connection Cable 22.

In at least one further embodiment, the system may also include a Circuit Breaker 84 positioned substantially within the Main Housing Assembly 20 and electrically coupled between the Main Power Connection Cable 22 and at least one electrical outlet. For purposes of this disclosure the term "Circuit Breaker" also includes traditional fuses and other current interrupting circuits.

The system may also be configured to be coupled to a 240 V supply rather than a 110 V supply without diverting from the present invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A Light and Power Distribution System for Non-Occupied Structures comprising:

a main housing assembly coupleable to a wall of the non-occupied structure;

a main power connection cable for electrically coupling to an electrical service, wherein said main power connection cable is adapted for electrically coupling to a household outlet;

at least one electrical outlet operationally coupled to the main housing assembly and electrically coupled to said main power connection cable;

an LED Driver Assembly operationally coupled between said main power connection cable and said at least one illumination member, said LED Driver Assembly is positioned within said main housing assembly;

said at least one illumination member being at least one LED assembly;

a Lighting Routing Cable electrically coupled between said LED Driver Assembly and said LED Assembly, said Lighting Routing Cable facilitating placement of the LED Assembly distally from said Main Housing;

at least one Remote Outlet Assembly for providing household power;

at least one Outlet Routing Cable electrically coupled between said main power connection cable and said at least one Remote Outlet Assembly, said Outlet Routing Cable facilitating placement of said at least one Remote Outlet Assembly distally from said Main Housing; and an Occupancy Sensor positioned substantially within said main housing assembly and electrically coupled between said main power connection cable and said LED Assembly for selectively turning said LED Assembly on/off.

2. The Light and Power Distribution System of claim 1, further comprising a Switch Member positioned substantially within said main housing assembly and electrically coupled between said main power connection cable and said LED Assembly for selectively turning said LED Assembly on/off.

3. The Light and Power Distribution System of claim 1 further comprising:

a Ground Rod positionable into the ground adjacent to the Non-Occupied Structure;

a Ground Connection Cable conductively coupled between the Ground Rod and said Main Housing Assembly;

Said Ground Connection Cable being conductively coupled to a ground wire of said Main Power Connection Cable.

4. The Light and Power Distribution System of claim 1 further comprising a Circuit Breaker positioned substantially within said Main Housing Assembly and electrically coupled between said Main Power Connection Cable and at least said electrical outlet.

* * * * *